US009644358B2

(12) United States Patent
Qualls et al.

(10) Patent No.: US 9,644,358 B2
(45) Date of Patent: May 9, 2017

(54) METHOD OF AUTOMATICALLY CLEANING A TOILET BOWL

(71) Applicant: Prince Demond Qualls, Terrell, TX (US)

(72) Inventors: Prince Demond Qualls, Terrell, TX (US); April Renea Jones, Terrell, TX (US)

( * ) Notice: Subject to any disclaimer, the term of this patent is extended or adjusted under 35 U.S.C. 154(b) by 490 days.

(21) Appl. No.: 14/188,910

(22) Filed: Feb. 25, 2014

(65) Prior Publication Data

US 2014/0246052 A1 Sep. 4, 2014

Related U.S. Application Data

(60) Provisional application No. 61/851,155, filed on Mar. 4, 2013.

(51) Int. Cl.
*E03D 9/00* (2006.01)
*A46B 13/02* (2006.01)

(52) U.S. Cl.
CPC ..... *E03D 9/002* (2013.01); *A46B 13/02* (2013.01); *A46B 2200/304* (2013.01)

(58) Field of Classification Search
CPC ..... A46B 13/02; A46B 2200/304; A46B 9/02; A46B 9/005; A46B 13/001; A46B 13/005; E03B 9/002; E03B 9/00; E03B 9/06; A47K 11/105; A47K 11/10; B08B 9/36
See application file for complete search history.

(56) References Cited

U.S. PATENT DOCUMENTS

| | | | |
|---|---|---|---|
| 3,829,906 | A | 8/1974 | McPhee |
| 3,837,018 | A | 9/1974 | Haberle |
| 3,919,726 | A | 11/1975 | Godwin |
| 4,091,473 | A | 5/1978 | Matthews |
| 4,183,105 | A | 1/1980 | Womack |
| 4,210,973 | A | 7/1980 | Decaux |
| 4,301,558 | A | 11/1981 | Decaux |
| 4,726,079 | A | 2/1988 | Signori |
| 4,745,639 | A | 5/1988 | Wileman, III |

(Continued)

FOREIGN PATENT DOCUMENTS

| | | | | |
|---|---|---|---|---|
| DE | 29621394 U1 * | 2/1997 | ..... | A46B 13/02 |
| WO | WO 2013008212 A1 * | 1/2013 | ..... | E03D 9/00 |

*Primary Examiner* — Katelyn Whatley
(74) *Attorney, Agent, or Firm* — Law Office of Jeff Williams; J. Oliver Williams

(57) ABSTRACT

The invention contemplates automatic cleaning of an entire toilet bowel using an electrically powered motor that simultaneously spins flexible, but rigid, circular brushes that are substantially the same length as the height of the bowl in both vertical and horizontal directions, not only around the bowl, but also along the height of the bowl, with special attention to the two parts of the bowl that collect the most rust and debris: at the "water line" and "under the rim". The longer one waits to clean a toilet bowl, the more likely an anti-rust chemical will be required to soak the water line and under the rim for a few minutes prior to brushing; and before administering chemicals, the toilet should be flushed. Automatically flushing, releasing chemicals, and soaking before cleaning (and then repeating until all debris is removed) requires a programmable microprocessor and debris sensor(s) to truly operate automatically.

5 Claims, 6 Drawing Sheets

(56) References Cited

U.S. PATENT DOCUMENTS

| | | | | |
|---|---|---|---|---|
| 4,797,959 | A | 1/1989 | Decaux | |
| 4,924,532 | A | 5/1990 | Pennestri | |
| 5,090,069 | A | 2/1992 | Decaux | |
| 5,279,008 | A | 1/1994 | Ritter | |
| 5,446,928 | A | 9/1995 | Daniels | |
| 5,596,774 | A | 1/1997 | Howard | |
| 5,647,074 | A | 7/1997 | White, Jr. | |
| D393,060 | S | 3/1998 | Ehrensperger | |
| 5,765,237 | A | 6/1998 | Okamoto | |
| 5,806,105 | A | 9/1998 | Yu | |
| 6,003,159 | A | 12/1999 | Sadegh et al. | |
| 6,944,894 | B1 | 9/2005 | Blevins | |
| 7,243,379 | B2 | 7/2007 | Panopoulos | |
| 7,269,863 | B1 | 9/2007 | Blevins | |
| 2006/0021121 | A1 | 2/2006 | Moussa | |
| 2009/0044322 | A1 * | 2/2009 | Nunez | A46B 11/00 4/223 |

* cited by examiner

METHOD OF AUTOMATICALLY CLEANING A TOILET BOWL

RELATED APPLICATIONS

This application claims the benefit of U.S. Provisional Application Ser. No. 61/851,155, filed on Mar. 4, 2013.

FIELD OF THE INVENTION

The invention provides for the automatic cleaning of an entire toilet bowel using an electrically powered motor that simultaneously spins flexible, but rigid, circular brushes that are substantially the same length as the height of the bowl in both vertical and horizontal directions.

BACKGROUND OF THE INVENTION

Cleaning the toilet is one of the less pleasant chores facing many homeowners. Doing a thorough job can require a certain amount of time, elbow grease, and effort. At present, there are a variety of products designed to treat the water handled by such fixtures. Although these can help reduce the frequency at which the interior of their bowls must be cleaned, their effect is limited against heavy deposits. When the washing machine was first introduced at the turn of the century, homemakers not only became more productive, they also became free of the most difficult and arduous household chore of that time. They became freer to pursue their own educations and careers, and therefore in a sense, society benefited as a whole. Today the most difficult and arduous household chore is CLEANING THE TOILET. Additionally, the number of bathrooms per household has increased over the years, especially in the ever larger mansions being built today with the number of bathrooms doubling and tripling per unit. It is not only arduous and smelly to clean the ever increasing number of toilet bowls in the world, but it is also degrading to one's soul. Mankind can do better.

Over the years, many attempts have been made to automate the toilet, some using programmable key pads and electrically controlled functions and features, while others used auto-release chemicals such as antiseptics. The first "automatic flushing toilet system" was invented by Masakazu Matsunaga of Asaka, Japan (U.S. Pat. No. 4,134,163, issued Jan. 16, 1979, hereinafter, "Matsunaga"). Matsunaga disclosed "an automatic flushing system for flushing a plurality of toilet bowls with water, which is provided with a solenoid-controlled valve and a detecting device. So long as the detecting appliance detects no toilet user, the solenoid-controlled valve is opened every time a predetermined time lapses, thereby to flush all the toilet bowls. If only one toilet user is detected, the solenoid-controlled valve is opened thereafter upon lapse of a reference time shorter than the predetermined time, thereby to flush the toilet bowls. If two or more toilet users are detected, the solenoid-controlled valve is opened thereafter upon lapse of a time shorter than the reference time, the time being shorter by a predetermined length for each additional toilet user detected." Martin J. Layerty, Jr. of Earlysville, Va. (U.S. Pat. No. 4,793,588, issued Dec. 27, 1988, hereinafter, "Layerty") is the earliest reference to a fully automatic flush toilet with a sensor. Layerty disclosed an "invention [that] relates to flush valves in which an external operating handle is eliminated. An electronic sensor, solenoid valve and a solenoid contained within a single unit to operate a flush valve are provided which is either built into the flush valve or can be retrofitted to a conventional flush valve with an external operating handle. The solenoid valve can also be controlled by external means separate and apart from the infra-red sensor mechanism." Layerty controlled his "sensor operated flush valve" by the magnetization of a coil. Actuation of the coil for a pre-set period of time is caused by a timer which is started by a signal coming from the infrared sensor implanted in small round holes in a cap. The infrared sensor could sense if the toilet had been used and sent a signal after a preset period of time so as to electrify the coil. On May 3, 1994, U.S. Pat. No. 5,307,524 was issued to Bennie N. Veal (hereinafter, "Veal") which included an "automatic toilet seat device which will cause a toilet seat to be either raised or lowered" under the control of a micro-processor controlled first switch that activates an electric motor to raise the toilet seat and "a float switch associated with a tank of the toilet" which activates the motor to lower the toilet seat after the toilet has been flushed. Further, U.S. Pat. No. 4,183,105 was issued to Leo K. Womack on Jan. 15, 1980 that introduced the automatic infusion into a toilet bowl of chemicals "admixed with water" to "clean, disinfect, and deodorize" the bowl.

With all the sophisticated automation and advanced technical features of the prior art toilet bowl cleaning systems, one must ask, "what is that manual toilet bowl cleaning brush doing next to almost every toilet in almost every home?" The world is well aware of the automatic flushing toilets like Matsunaga and Layerty, which employed automatic sensors that sense humans and/or toilet bowl debris alike to automatically flush toilets in conjunction with timers, etc. It is also well known in the art that electric motors under the control of micro-processors can be used to raise and lower toilet seats either before or after flushing, etc. (Veal). Furthermore, automatic infusion into toilet bowls with chemicals is also well known. (Womack) So with all this automation, why do humans continue to use brushes manually controlled by humans to actually wash in inner rim and vertical wall of toilet bowls, worldwide?

A need now exists to eliminate the manual toilet bowl cleaning brush and to replace it with an improved, low maintenance, apparatus and method for the automatic cleaning of an entire toilet bowel using an electrically powered motor that simultaneously spins flexible, but rigid, circular brushes that are substantially the same length as the height of the bowl in both vertical and horizontal directions; not only around the bowl, but also along the height of the bowl, with special attention on the two parts of the bowl that collect the most calcium, lime, rust and debris: at the "water line" and "under the rim". Many times, the longer one waits to clean a toilet bowl, the more likely an anti-calcium, lime and/or rust (hereinafter just "rust") chemicals will be required to soak the water line and under the rim first, for a few minutes, before cleaning the bowl rigorously with a brush. Otherwise, even the use of manual brushes can be ineffective. Therefore, the automatic introduction of anti-rust chemicals for timed soaking before cleaning is also needed to achieve full automation of the task of cleaning a toilet bowl.

SUMMARY OF THE INVENTION

This invention can be implemented using a modified toilet design, or a new toilet seat design. Either implementation would differ from conventional units through the incorporation of a set of motor-driven brushes that could automatically clean the interior of the bowl, can optionally be microprocessor-controlled. The simplest use of the invention would require an individual to merely add a suitable rust cleaner to the bowl. Wait a few minutes, and then activate the system. Once it finished, the brushes would automatically stop and retract back into their stowed positions.

One embodiment of the invention provides for the automatic cleaning of an entire toilet bowel using an electrically powered motor that simultaneously spins flexible, but rigid, circular brushes that are substantially the same length as the height of the bowl in both vertical and horizontal directions, not only around the bowl, but also along the height of the bowl, with special attention to the two parts of the bowl that collect the most rust and debris: at the "water line" and "under the rim". Many times, the longer one waits to clean a toilet, the more likely an anti-rust chemical will be required to soak the water line and under the rim for a few minutes prior to brushing. Further, before one administers the chemicals, the toilet should be flushed to eliminate any residual debris. Automatically flushing the toilet, and the release of anti-rust chemicals just prior to cleaning, waiting for several minutes, and then controlling both backward and forward spinning of a motor with its' shaft turning a brush rotation mechanism, requires a programmable microprocessor to truly operate automatically. There are fundamentally several embodiments of the invention that vary from the simplest embodiment where a microprocessor is not required, and where pre-flushing and/or introduction of chemicals into the bowl may be done manually, to a more advanced embodiment that may require the user to press an appropriate button to perform any particular brushing cycle in a forward or backward direction for the time duration desired, for example. Further, one can contemplate many alternative advanced embodiments optionally incorporating use of a hot water source, for example; or placing the rotation means within the toilet seat itself, rather than built into the rim of the bowl. Other contemplated embodiments may capitalize on new technologies such as "wireless power" between a programmable display device situated on top of the toilet lid that controls electric motors and valves, wirelessly. One embodiment of the invention contemplates a wireless power source at an AC outlet in a bathroom, and a wireless receiver located under or behind the toilet bowl, including a wireless keypad fixidly attached to the lid of the tank, that wirelessly controls a motor to automatically flush the toilet; a wireless mechanism to automatically release anti-rust chemicals on one schedule and optionally release anti-septic chemicals on another schedule; and another motor, powered wirelessly or not, that turns and rotates cleaning brushes that circumnavigates the toilet bowl.

One embodiment is a modified residential, tank-style toilet. As with conventional units, it would be produced of vitreous china and would utilize a two-piece, separate tank and bowl configuration. It would differ from the prior art by the incorporation of a self-cleaning system in the form of a pair of rotating brushes. These would be mounted on tracks on the upper inside edge of the bowl and would be able to move around the bowl when actuated. The unit would be linked to a micro-processor control and display that could also retract the units when not in use.

The invention must meet with the specifications set forth by the National Standard Plumbing Code (NSPC) and a variety of local building codes, and could require a password to operate for safety. In addition, since it would involve electrical wiring and circuitry, it is likely that approval would have to be obtained from Underwriters Laboratories (UL). UL approval involves the testing of prototype and/or production units primarily as relates to fire safety.

As with conventional fixtures of this nature, one embodiment could be produced of cast, glazed, and fired vitreous china, or of cast iron or stainless steal for increased strength, particularly around the rim holding the brush rotation mechanism. In order to provide the clearance for the tracks and space for the unit's control system, recesses may have to be cast into the bowl and tank. The ball cock, trip lever, flapper valve, overflow tube, and related items could all be standard components. Any type of flushing apparatus is contemplated, whether it be gravity based or water pressure based. The cleaning system could employ replaceable polyester or nylon bristle-based, twisted stainless steel wire brushes that could be mounted in arbors on the output shafts of a pair of small, electrically operated motors or on wheels or ball bearings that rotate the brushes. The tracks, guides, ball bearings, and brush mounting elements could be made of cast and machined stainless steel. The latter could be equipped with small rollers. They could potentially employ a rubber tire, belt or chain-based drive system linked to additional motors at the rear end of the bowl. Limit switches and related hardware could be standard items. The unit could employ standard integrated circuit chips, resistors, push-button elements, and related components for its control circuit. These could be contained within a sealed plastic housing.

The many objects and advantages of the present invention will become apparent to those skilled in the art when the following description of the invention and its various embodiments are reviewed in accompaniment with the attached drawings wherein like reference numerals refer to like components throughout. The previously described embodiments of the present invention have many advantages. Although the present invention will be described in considerable detail with reference to certain preferred embodiments thereof, other alternative embodiments are possible. Therefore, the spirit and scope of the claims should not be limited to the description of the preferred embodiments, nor the alternative embodiments, contained herein.

DETAILED DESCRIPTION OF THE INVENTION

Figure 1:
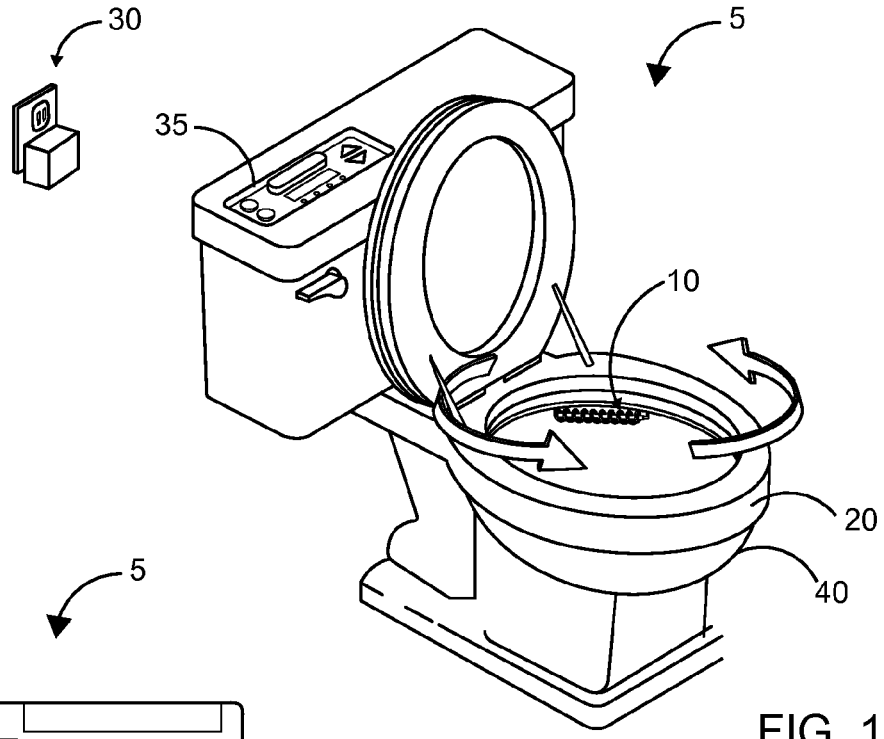
FIG. 1 is a perspective view of an exemplary fully wireless embodiment of the low maintenance commode 5 according to the invention. Movement of removable retractable brushes 10 is shown by arrows around the rim 20 of the commode 5. The wireless power supply 30 is also depicted.
Figure 2:
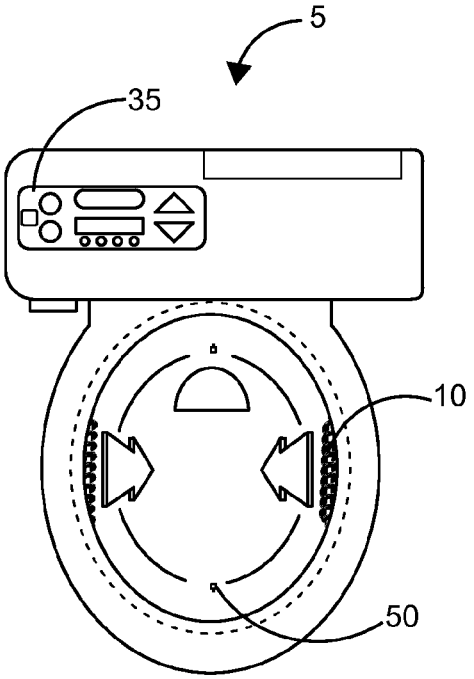
FIG. 2 is a top view of selected elements of the low maintenance commode 5 with the programmable input/output display 35 depicted along with removable retractable brushes 10 shown in the retracted position. Extension of the brushes during rotation in the forward direction around the rim 20 is illustrated by arrows.
Figure 3:
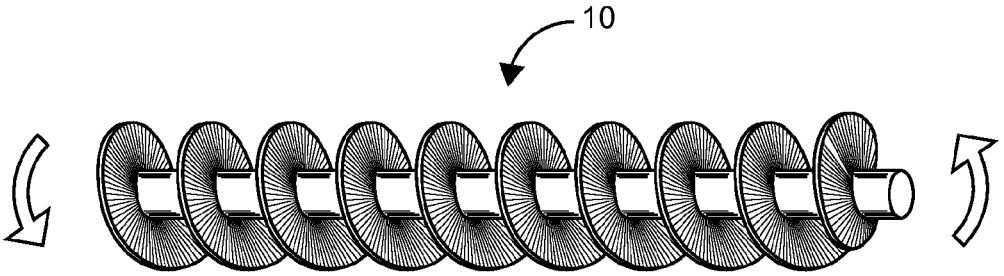
FIG. 3 is an example of a removable retractable brush 10 with arrows showing rotation of the brush during normal operation in one preferred embodiment.

FIGS. 1-3 depict an automatic toilet bowl cleaning system comprising: at least one removable retractable brush 10 movably attached to a rigid adjustable vertical to horizontal tension control guide 11 adapted for travel along an outer track 12 spanning the outer horizontal circumference of an upper rim 20 inside a toilet bowl 40, wherein an inner track 13 is rigidly attached using a bolt or rivet (not shown) through threads 14 to an inside under cover of said upper rim 20, thus allowing the outer track 12 to spin freely within said upper rim 20.

FIGS. 4A-C and FIG. 8 show a fixed reversible motor 100 powered by a power supply 30 engaging a brush rotation mechanism 15 positioned between a water tank 16 and said toilet bowl 40 operable to engage said at least one removable retractable brush 10 along said outer track 12, said at least one removable retractable brush 10 being forced into engagement with the vertical walls of said toilet bowl 40 by said rigid adjustable vertical to horizontal tension control guide 11 when said motor 100 is rotating in a forward direction and retracting horizontally to said upper rim 20 of said toilet bowl 40 when said motor 100 is rotating in a backward direction. Pathways connecting said toilet bowl 40 and said water tank 16 exist on most all commercially available toilets. Therefore, these same pathways can be used to route liquids such as anti rust or antiseptic chemicals 17 from either inside or outside the water tank 16 to said toilet bowl 40, dousing said at least one removable retractable brush 10 while said chemicals 17 flow with water to settling at the water line inside the bowl 40 just below optional electrical debris sensors 50 (See FIGS. 2 and 5). These electrical sensors 50 can be infrared sensors that detect debris obstructing their line of site, or other types of sensors currently in use, all of which, control the automatic flushing of a toilet bowl 40.

At least one electrical switch (not shown) configured to relay power from said power supply 30 for control of said motor 100 can be used and programmed by a programmable input/output display 35 using a micro-processor (not shown) that can be programmed to discern whether a prior flushing, chemical soak, and scrubbing cycle actually removed the debris sensed by the sensors 50, and decide whether to flush, soak, and scrub again. A predetermined number of cycles that does not remove the debris could cause the programmable input/output display 35 to flash a notice that operation has been stopped, indicating either that the brushes need adjusting or replacing, that the user is out of chemicals, or other such alert.

Figure 4A:
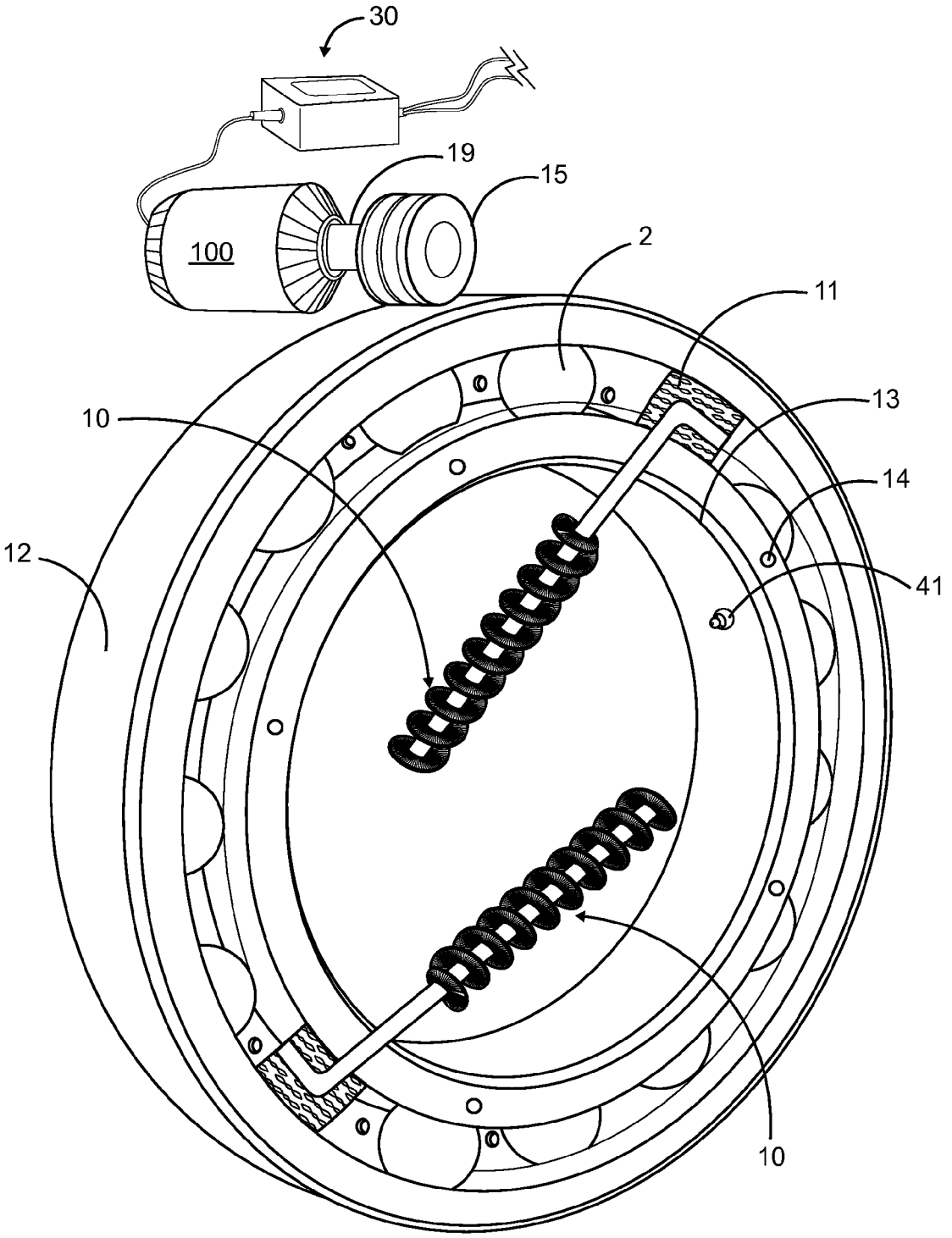
FIG. 4A is a partially cutaway perspective top view under the rim 20 of a possible tire and ball bearing brush rotation mechanism embodiment of the low maintenance commode.
Figure 4B:
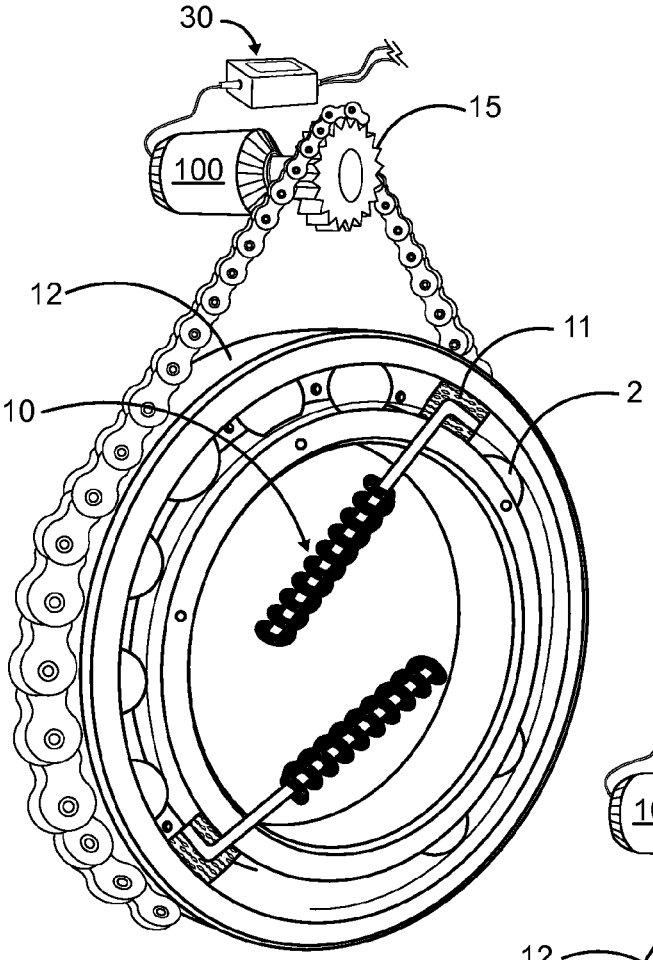
FIG. 4B is a partially cutaway perspective top view under the rim 20 of a possible chain and sprocket ball bearing brush rotation mechanism embodiment of the low maintenance commode.
Figure 4C:
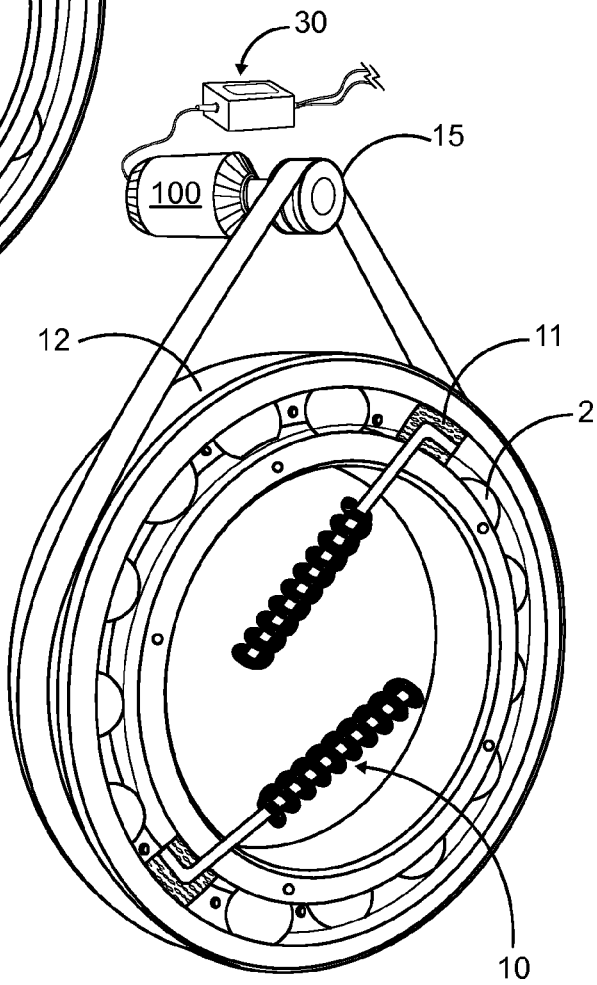
FIG. 4C is a partially cutaway perspective top view under the rim 20 of a possible belt and spool ball bearing brush rotation mechanism embodiment of the low maintenance commode.
Figure 8:
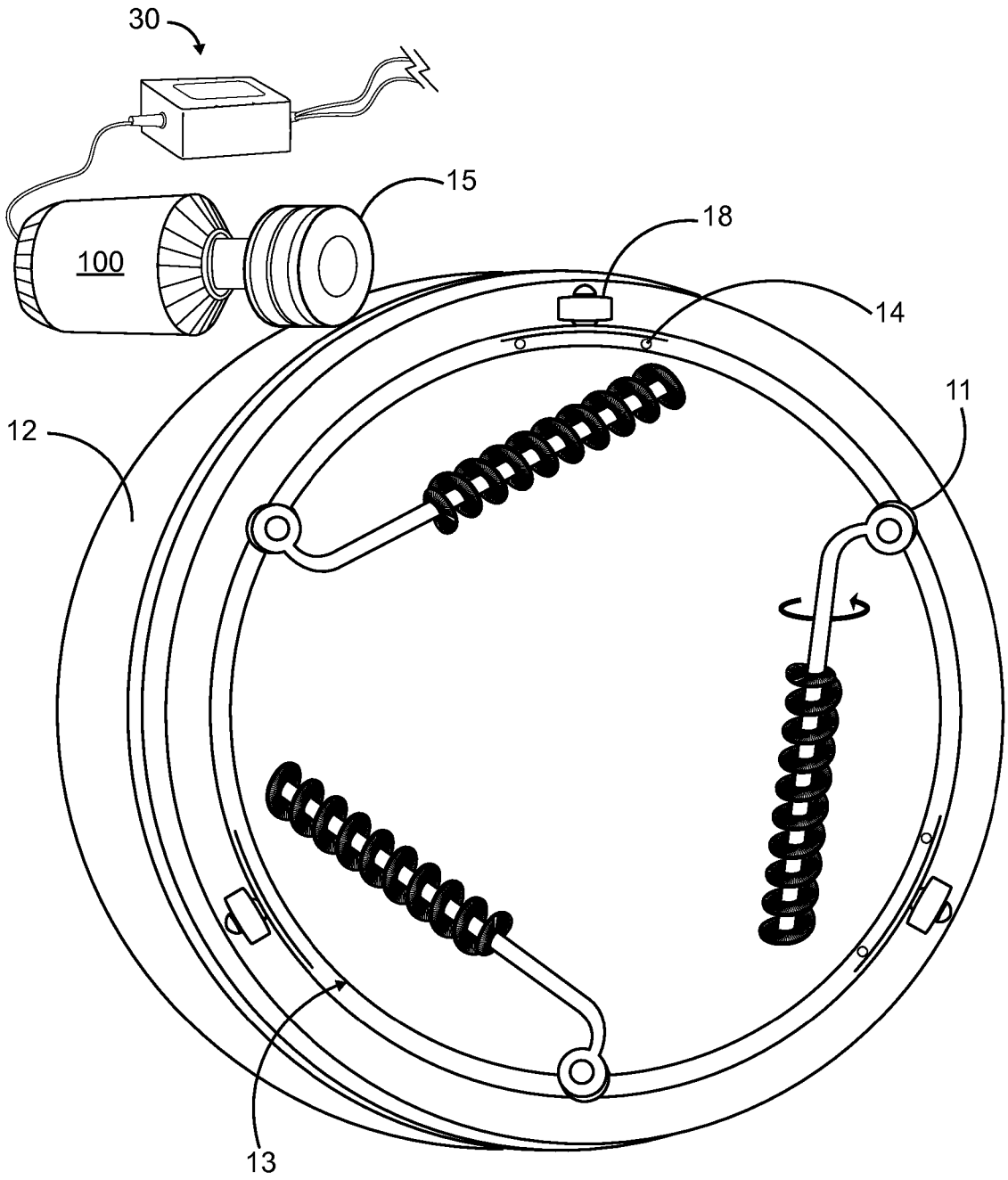
FIG. 8 is a side view of another exemplary rotation means of the low maintenance commode 5 not using ball bearings.

The automatic toilet bowl cleaning system does not require the use of ball bearings 2 as the rotation means (FIGS. 4A-C). Another rotation means is depicted in FIG. 8 where said inside under cover of said upper rim 20 of said toilet bowel 40 is rigidly affixed to said inner track 13, thus rigidly holding in place said inner track 13 having a plurality of wheels 18 connecting between said inner track 13 and said outer track 12, spanning the entire circumference of said upper rim 20, allowing said outer track 12 to spin freely within said rim 20 of said toilet bowl while engaged by said brush rotation mechanism 15. In this embodiment, the rigid vertical to horizontal tension control guides 11 can be wheels adjacent the outer track 12 that spin the brushes 10 when rotated by the brush rotation mechanism. Tension control may be maintained by the tinsel strength, composition, and size of the removable retractable brushes 10 employed. Alternatively, the control guides 11 may be spring loaded (not shown) to ensure uniform, continuous and effective cleaning pressure of the brushes 10 against the entire circumference of said toilet bowl 40.

Figure 7:
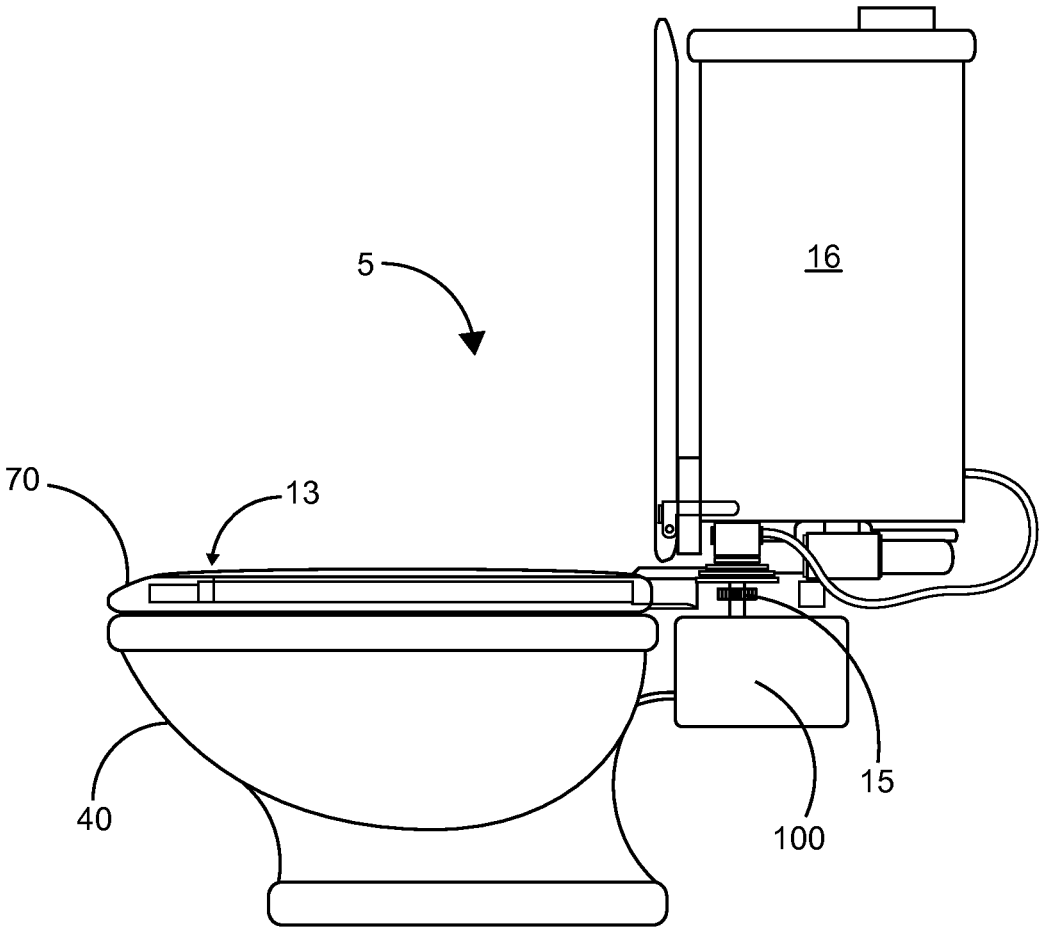
FIG. 7 is a side view of an exemplary embodiment of the low maintenance commode 5 where the rotation means is built inside the seat 70.

FIG. 7 depicts the automatic toilet bowl cleaning system 5 wherein a toilet seat 70 of said toilet bowel 40 rigidly envelopes and is affixed to said inner track 13, thus holding in place said outer track by ball bearings 2 between said inner track 13 and said outer track 12, spanning the entire circumference of said toilet seat 70, wherein said outer track 12 has less vertical width than said inner track 13, allowing said outer track 12 to spin freely within said toilet seat 70 of said toilet bowl 40 while engaged by said brush rotation mechanism 15. Note that FIG. 7 could also contemplate the other, non-ball bearing, rotation means depicted in FIG. 8 as well.

Another embodiment of the automatic toilet bowl cleaning system contemplates an inside under cover of said upper rim 20 of said toilet bowel 40, rigidly affixed to said inner track 13, thus rigidly holding in place said inner track 13 and thus said outer track 12 by ball bearings 2 connecting between said inner track 13 and said outer track 12, spanning the entire circumference of said upper rim 20, allowing said outer track 13 to spin freely within said rim 20 of said toilet bowl 40 while engaged by a tire brush rotation mechanism 15 FIG. 4A, a chain and sprocket brush rotation mechanism 15 FIG. 4B, or a belt and spool brush rotation mechanism 15 FIG. 4C, all engaging said outer track 12 to cause spin around said rim 20 through a shaft 19 attached to said motor 100.

Figure 6:
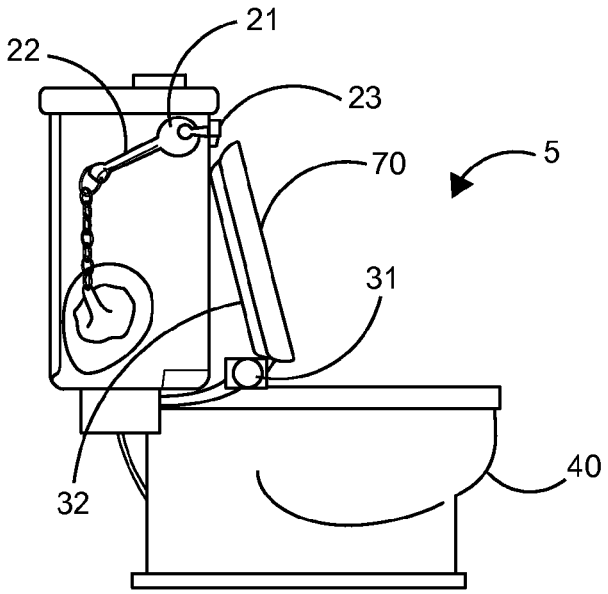
FIG. 6 is a side view of an exemplary automatic flushing embodiment of the low maintenance commode 5.

FIG. 6 depicts another contemplated embodiment which includes using a second motor 21 within said water tank connected to electronic means (not shown) adapted to automatically flush said toilet bowl 40 by turning a second shaft 22 to lift the manual flush mechanism 23, causing water to pass through said pathway, said second motor 21 controlled by said at least one electrical switch (not shown) configured to relay power from said power supply 30 for control of said second motor 21. Alternatively, automatic flushing can be accomplished by the various prior art means of automatic flushing as described in Matsunaga and Layerty using said electronic sensor 50 and a solenoid valve (not shown), to operate a flush valve (not shown) which is either built into the flush valve or can be retrofitted to a conventional flush valve with an external operating handle 23. The solenoid valve can also be controlled by external means separate and apart from the infra-red sensors 50.

Figure 5:
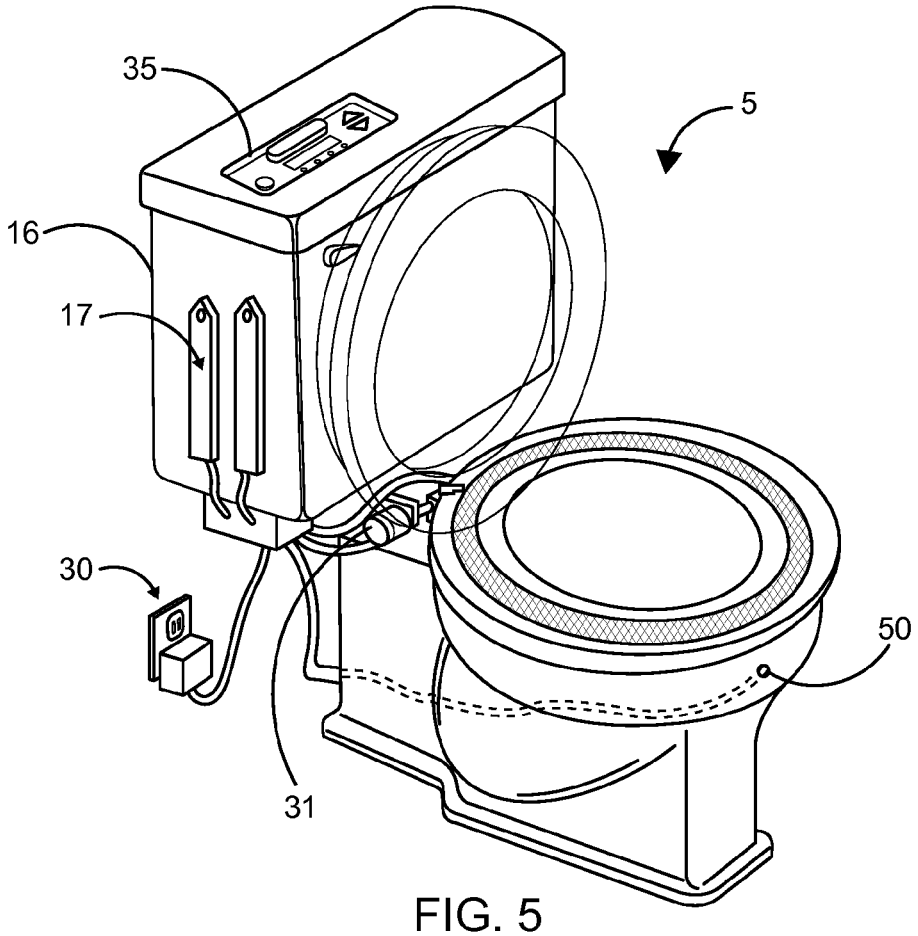
FIG. 5 is a perspective view of an exemplary partial wireless embodiment of the low maintenance commode 5 according to the invention. The power supply 30 is depicted here plugged into an AC outlet.

FIGS. 5-6 also depict another contemplated embodiment which includes using a third motor 31 positioned under said water tank 16 and behind said toilet bowl 40 for raising and lowering a toilet lid 32 and a toilet seat 70 of said toilet bowl 40, said third motor 31 comprising a third shaft (not shown) extending from said third motor 31 adapted for connection to said toilet lid 32 and said toilet seat 70 such that rotation of said third shaft is operable to optionally cause said toilet lid 32 and toilet seat 70 to be raised or lowered, said third motor 31 receiving at least one electrical control signal from said at least one electrical switch (not shown). As described above, it is well known in the art to employ electric motors under the control of micro-processors to raise and lower toilet seats either before or after flushing, etc. (Veal). Similar apparatus is contemplated herein, and therefore, does not require further elaboration.

The automatic toilet bowl cleaning system further contemplates at least one electrical switch including current detection means for detecting over-current in the reversible motor 100, the second motor 21 and/or the third motor 31, said current detection means detecting over-current in any motor when movement of said at least one brush 10 is impeded such that the control circuit means deactivates any of said motors. This is also well known in the art.

The automatic toilet bowl cleaning system 5 further contemplates a programmable input/output display 35 connected to said at least one electrical switch (not shown) controlled by a microprocessor (not shown) to enable human programming of the schedule and automatic operation of the automatic toilet bowl cleaning system 5. It is also contemplated that the automatic toilet bowl cleaning system 5 motors (100, 21 and 31) are configured within waterproof housings. For example, said ball bearings 2 can be substantially enclosed within a waterproof housing within said rim 20, and said inner track 13 of said ball bearings 2 is configured with a grease nipple 41 (FIG. 4A) for receiving grease to lubricate the ball bearings 2.

Operation of the automatic toilet bowl cleaning system 5 contemplates said microprocessor (not shown) further comprising a timer (not shown) controlled by said microprocessor for the automatic scheduling and operation of the automatic toilet bowl cleaning system 5 to function in timed cycles comprising:

a close lid cycle, at least one automatic flushing cycle, at least one optional sensing cycle, at least one chemical release cycle, at least one cleaning cycle while brushes spin vertically in the forward direction, at least one cleaning cycle while brushes retract and spin horizontally in the backward direction, and an open lid cycle.

It is contemplated that each removable retractable brush 10 can be removably connected directly to a single ball of a ball bearing 2 (FIGS. 4A-C) in one embodiment or to a ball in socket wheel or tire controlled by said rigid adjustable vertical to horizontal tension control guide 11 in another embodiment (FIG. 8) which can cause spin of the brushes 10. Further, the inside under cover of said upper rim 20 can be rigidly affixed to a lower rim of the top of said toilet bowl 40 using a plurality of nuts and bolts (not shown) to permit easy access for replacement of the brushes 10, the ball bearings 2, and the brush rotation mechanism 15.

FIG. 5 shows at least one chemical dispenser 17 attached to said water tank 16 and adapted to dispense chemicals to water passing through said pathways and controlled by a chemical valve (not shown) by at least one electrical switch (not shown). This structure is well known in the prior art, and is therefore not depicted in the drawings. A fully automated embodiment of the invention contemplates at least one electrical sensor 50 connected to said power supply 30 for viewing inside said toilet bowl 40 using at least one detector lens (not shown) positioned just above the water level inside of said toilet bowl 40 to automatically detect rust and stuck debris inside said toilet bowl 40 near the water line, controlled by said at least one electrical switch (not shown). The sensor 50 can also automatically detect and signal the microprocessor (not shown) to dispense chemicals through said chemical dispenser 17 controlled by a chemical valve (not shown) by said at least one electrical switch. This process can cause scrubbing and soaking to repeat until the debris is eliminated, or it can be used to alert the user that something is wrong.

The less automated method for automatically cleaning a toilet bowl 40 using an automatic toilet bowl cleaning system 5, wherein a programmable input/output display implements human activated automatic scheduling and operation of the automatic toilet bowl cleaning system to function in timed cycle steps, could comprise the steps of:

manually flushing the toilet, automatically cleaning while brushes 10 spin vertically in the forward direction along the walls of said toilet bowl 40, cleaning while brushes 10 retract and spin horizontally in the backward direction along the walls of said toilet bowl 40 and along the upper rim 20 of said toilet bowl 40 when fully retracted, and optionally repeating any previous steps as frequently and as intermittently as desired.

A bit more automation contemplates using a programmable input/output display 35 to control a microprocessor (not shown) to implement human activated automatic scheduling and operation of the automatic toilet bowl cleaning system 5 to function in timed cycle steps, further comprising the steps of:

closing a toilet lid 32 and toilet seat 70 of said toilet bowl 40 before cleaning, and opening the toilet lid 32 after all prior soaking and cleaning steps complete.

The method for automatically cleaning a toilet bowl 40 using an automatic toilet bowl cleaning system 5 further contemplates using a programmable microprocessor display which implements human activated automatic scheduling and operation of the automatic toilet bowl cleaning system to function in timed cycle steps, further comprising the step of automatically releasing chemicals into said toilet bowl 40 and waiting a time period for soaking intermittently between any prior step.

The method for automatically cleaning a toilet bowl 40 using an automatic toilet bowl cleaning system 5 further contemplates using a programmable microprocessor display to implement human activated automatic scheduling and operation of the automatic toilet bowl cleaning system 5 to function in timed cycle steps, further comprising the step of automatically detecting debris which trigger the release of chemicals into said toilet bowl 40 for a pre-defined time period for soaking intermittently between any prior step.

The least automated method for automatically cleaning a toilet bowl 40 using an automatic toilet bowl cleaning system 5 further contemplates using at least one on/off switch (not shown) on a panel display 35 ("panel display" and "programmable input/output display are used interchangeable herein) which implements human activated automatic cleaning of a toilet bowl 40 in pre-programmed timed cycle steps, comprising the steps of cleaning while brushes 10 spin vertically in the forward direction along the walls of said toilet bowl 40, and cleaning while brushes 10 retract and spin horizontally in the backward direction along the walls of said toilet bowl 40 and along the upper rim 20 of said toilet bowl when fully retracted.

The foregoing detailed description is to be clearly understood as given by way of illustration and example only, the spirit and the scope of this invention being limited solely by the appended claims. Most prior art structure disclosed in the application that incorporates certain features in combination with applicant's invention is not depicted, but rather one skilled in the art should include that structure by reference to the prior art patents described herein for a more detailed description.

The invention claimed is:

1. A method for automatically cleaning a toilet bowl using self-cleaning automatic toilet bowl cleaning system, wherein a programmable microprocessor implements upon activation automatic scheduling and operation of the self-cleaning automatic toilet bowl cleaning system to function in timed cycle steps, comprising:

flushing a toilet, cleaning while brushes spin vertically in the forward direction along the walls of said toilet bowl, cleaning while the brushes retract and spin horizontally in the backward direction along the walls of said toilet bowl and along the upper rim of said toilet bowl when fully retracted, and optionally repeating any prior steps as frequently and as intermittently as desired.

2. The method of automatically cleaning a toilet bowl using the self-cleaning automatic toilet bowl cleaning system of claim 1, further comprising a step of sensing debris at a water line of said toilet bowl after each cleaning step and selectively flashing an alert on a display.

3. The method for automatically cleaning a toilet bowl using the self-cleaning automatic toilet bowl cleaning system of claim 1, further comprising steps of:

closing a toilet lid of said toilet bowl, and opening the toilet lid after all prior steps are complete.

4. The method for automatically cleaning a toilet bowl using the self-cleaning automatic toilet bowl cleaning system of claim 2, further comprising a step of automatically releasing chemicals into said toilet bowl and waiting a time period for soaking intermittently between any prior step.

5. The method for automatically cleaning a toilet bowl using the self-cleaning automatic toilet bowl cleaning system of claim 3, further comprising a step of further automatically detecting debris which triggers the release of chemicals into said toilet bowl for said time period for soaking intermittently between any prior step.

* * * * *